United States Patent [19]

Ryan

[11] 4,034,463

[45] July 12, 1977

[54] METHOD OF VERTICAL DISPLAY OF WALL PANELING

[76] Inventor: Robert E. Ryan, 608 Mountain Road, Smoke Rise, Kinnelon, N.J. 07405

[21] Appl. No.: 686,055

[22] Filed: May 13, 1976

[51] Int. Cl.[2] ..... B23P 11/02

[52] U.S. Cl. ..... 29/446; 29/463; 29/469; 29/526; 40/125 H; 52/239; 160/135

[58] Field of Search ..... 29/446, 463, 469, 526; 52/239; 40/125 H, 125 E, 125 R, 152.1; 160/135

[56] References Cited

U.S. PATENT DOCUMENTS

| | | | |
|---|---|---|---|
| 2,587,698 | 3/1952 | Corn et al. | 40/125 R UX |
| 3,171,223 | 3/1965 | Josephson | 40/152.1 X |
| 3,352,523 | 11/1967 | Vanderays | 40/125 R X |
| 3,428,108 | 2/1969 | Singer | 160/135 |
| 3,463,218 | 8/1969 | Cannon et al. | 40/125 R X |
| 3,565,152 | 2/1971 | Cohn, Jr. | 40/125 H X |
| 3,889,736 | 6/1975 | Firks | 160/135 |
| 3,927,481 | 12/1975 | Safranek | 160/135 X |
| 3,952,437 | 4/1976 | Mitchell | 40/152.1 |

*Primary Examiner*—Charlie T. Moon
*Attorney, Agent, or Firm*—Silverman and Jackson

[57] ABSTRACT

The present method for display of wall paneling includes the steps of securing two back-to-back panel samples within a perimeter and then in turn securing several of such perimeters within variously configured pre-formed angle channels in order to obtain a desired floor display pattern.

2 Claims, 7 Drawing Figures

*FIG. 2*

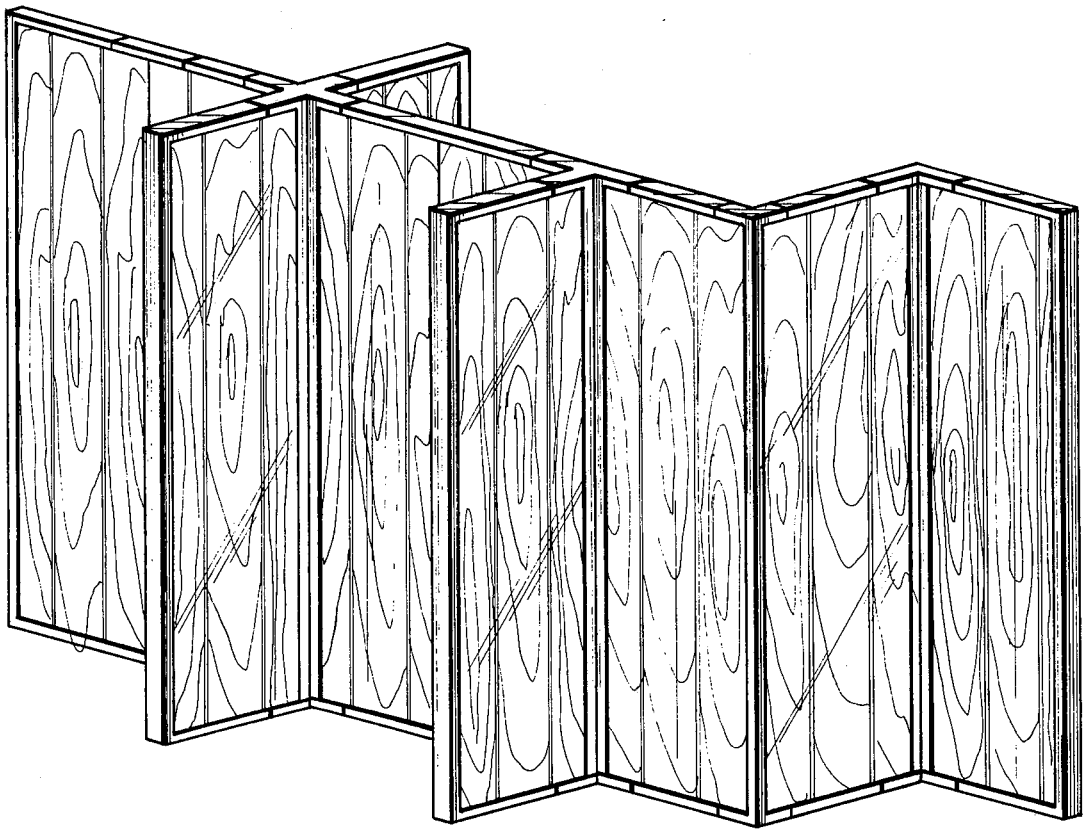
FIG. 1
FIG. 2
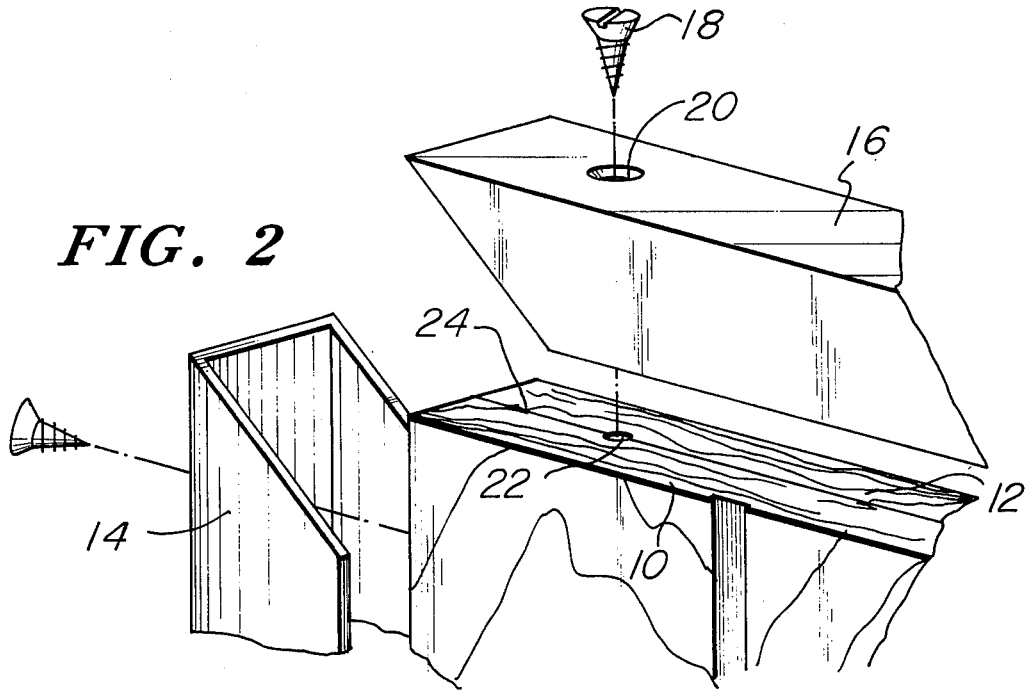

METHOD OF VERTICAL DISPLAY OF WALL PANELING

BACKGROUND OF THE INVENTION

Within the last 15 years, wall paneling has generally been sold by lumber dealers on a job lot basis. Originally, the display means utilized by the dealer was a small hand display. Then the multi-plex display appeared. This display is a wall-mounted,, leaf-type unit generally holding four-by-eight foot panels in a back-to-back rigid frame relationship. Such displays, while an improvement over the earlier hand displays, are quite bulky, difficult to install, and often are too heavy to be mounted upon the desired vertical wall or surface. Further, a customer wishing to look at more than two multi-plex panels at a time, would be frustrated in his attempts to do so. Further, the multi-plex display was generally limited to one interested party at a time and, additionally, would cost the dealer in the neighborhood of $100 per 5-leaf, 10 panel section.

A recent development in panel display pertains to the use of free-standing A-frames. The A-frame permits two different panels to be mass displayed in a vertical position within about 16 feet of floor space.

It is to be noted that many sellers of panels have simply laid the sheets of such panels flat on the floor, thereby piling up a half-dozen or more panels in horizontal fashion. The difficulties of this approach are obvious.

Another recent development is the so-called panel caddy which is intended to display samples of 16 inches by 24 inches. This is still a small size which, it it believed by most sellers and manufacturers, does not represent the best point of sale display situation.

Accordingly, a need has long existed for a display panel system which could (1) accommodate large sheets of paneling, (2) be flexible as to floor configurations, and (3) take up a minimum amount of floor space per displayed panel.

SUMMARY OF THE INVENTION

The present invention constitutes a method of vertical display of wall paneling, comprising the steps of placement of a plurality of framed segments permetrically about two back-to-back sheets of wall paneling in order to form a complete frame about such units of said paneling; formation of a plurality of pairs of aligned holes in both said frame segments and said wall paneling respectively, the second of each of said holes lying at the interface between said two sheets of paneling; inserting and tightening, into said aligned holes, a corresponding plurality of screws such that an expansion of the edges of said paneling against said frame segments is achieved, thereby securing said panels within said frame segments; and press-fitably securing said framed panels within a plurality of variously configured angle channels so as to thus obtain a free-standing wall system of virtually any desired configuration.

The essential flexibility of the present invention resides in combination of two mechanical advantages, namely, ease of removability of the panels from their peripherally enclosing pre-formed angle channels and, secondly, the manner in which a plurality of the framed panels may be readily assembled into any one of a selectable variety of differently configured display systems.

Further, it has been discovered that through the use of four different designs of pre-formed angle channels, almost any overall display configuration can be obtained.

Accordingly, it is an object of the present invention to provide a display system for wall paneling which will occupy a minimum of wall space while permitting a maximum of surface area of various types of wall paneling to be exhibited.

It is another object of the present system to provide a display means of the above type having a simplicity and ease of assemblage as well as a ready suitability to a broad variety of different floor configurations.

BRIEF DESCRIPTION OF THE DRAWINGS

FIG. 1 is a perspective view of a wall paneling display formed in accordance with the principles of the present invention.

FIG. 2 is an exploded view of one corner of one display unit showing the use of self-tapping screws.

DETAILED DESCRIPTION OF THE INVENTION

Figure 3:
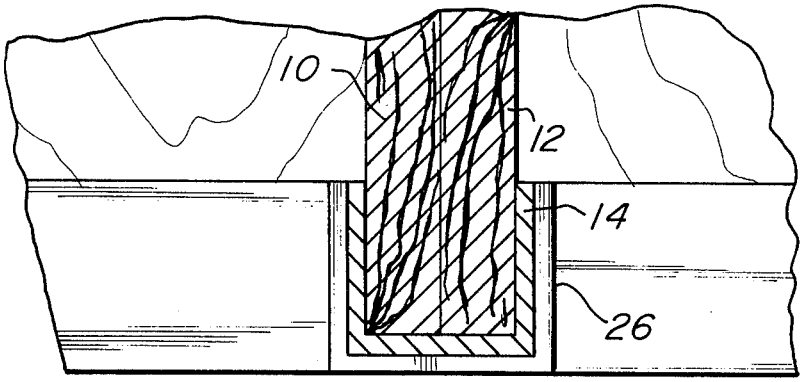
FIG. 3 is a cross-sectional view of a pair of display panels set back-to-back within one of the pre-formed angle channels of the present invention.

The present inventive method includes two steps of panel securement and alignment. The first of these steps, illustrated in FIG. 2, shows the back-to-back placement of two separate wood panels 10 and 12. These panels are then surrounded by four frame segments, two of which correspond to reference numerals 14 and 16.

Figure 4:
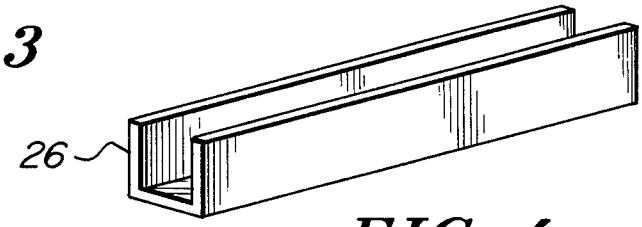
FIGS. 4 through 7 illustrate four different of the most common angle channels configurations utilized to effectuate the objects of the present invention.
Figure 5:
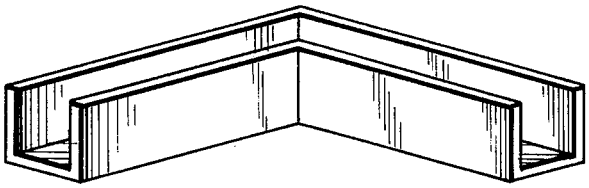
Figure 6:
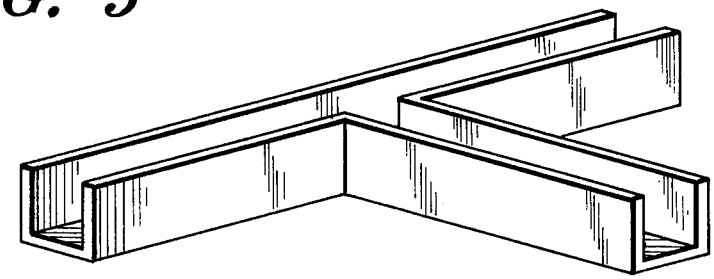
Figure 7:
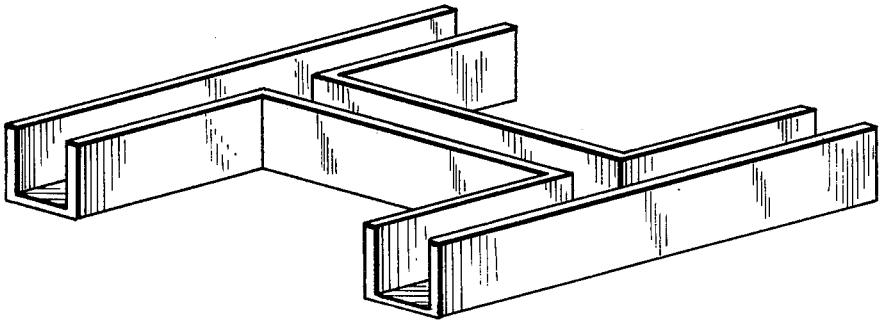

It is to be further noted in FIG. 2 that the securement within the frame segments is obtained through the use of a screw 18 which is passed through hole 20 and into hole 22 which has been partially pre-formed at the interface 24 between said panels 10 and 12. As the screw 18 is advanced into the hole 22, the panels 10 and 12 will be forced outward toward the side edges of the frame segments 14 and 16. This will result in a snug fit of the back-to-back panels 10 and 12 within the frame segments. After all of the desired sets of panels have been "framed", the configuration of the free-standing floor display is obtained through the pressfittable insertion of the framed panel units into a number of angle channels 26 having one or more of the configurations shown in FIGS. 4 through 7. As may be further noted from FIG. 1, said angle channels are utilized in order to obtain virturally any desired floor display configuration. Corresponding angle channels are placed at the top and bottom of each intersection point.

In order to assure stability of the present system, a plurality of rubber grommets can be placed along those surfaces of the frame segments which are not enclosed by angle channels.

Through the above-described method it has been found that an infinite variety of floor display configurations for paneling may be readily obtained.

Accordingly, it is seen that the object set forth in the Summary of the Invention have been effectively attained by the above-described embodiment to the present invention.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea of principles of this invention within the scope of the appended claims.

I claim

1. A method of vertical display of wall paneling, comprising the steps of :

a. placement of a plurality of channel-shaped frame segments perimetrically about two back-to-back sheets of wall paneling, in order to form a complete frame about such units of said paneling;

b. formation of a plurality of pairs of aligned holes in both said frame segments and said wall paneling respectively, the second of each of said holes lying at the interface between said two sheets of paneling;

c. inserting and tightening, into said aligned holes, a corresponding plurality of screws such that an expansion of the edges of said paneling against said channel-shaped frame segments is achieved, thereby securing said panels within said channel-shaped frame segments; and d. press-fittably securing adjacent portions of a plurality of units of said framed panels within a plurality of variously configured angled channels so as to thus obtain a free-standing wall system of virtually any desired configuration.

2. The method as recited in claim 1 in which said method further comprises the step of placing resilient grommets beneath areas of those frame segments not secured within one or more of said angled channels.

* * * * *